US005997001A

United States Patent [19]

Doss

[11] Patent Number: 5,997,001

[45] Date of Patent: Dec. 7, 1999

[54] BOARD GAME FOR PLAYING SIMULATED ICE HOCKEY

[76] Inventor: Roger K. Doss, 3527 Evans Ridge Trail, Atlanta, Ga. 30340

[21] Appl. No.: 09/019,239

[22] Filed: Feb. 5, 1998

[51] Int. Cl.[6] ..... A63F 3/00

[52] U.S. Cl. ..... 273/277; 273/285; 273/287

[58] Field of Search ..... 273/236, 277, 273/285, 287

[56] References Cited

U.S. PATENT DOCUMENTS

| | | | |
|---|---|---|---|
| 538,380 | 4/1895 | McKenzie | 273/286 |
| 1,692,402 | 11/1928 | Barthel | 273/277 X |
| 2,069,487 | 2/1937 | VanRiper | 273/285 X |
| 2,147,900 | 2/1939 | Houseknecht | 273/285 |
| 4,089,529 | 5/1978 | Usami | 273/282 |
| 4,241,924 | 12/1980 | Arcara | 273/277 |
| 4,872,550 | 10/1989 | Stranges | 273/285 X |
| 4,872,679 | 10/1989 | Bohaski et al. | 273/317.5 |
| 5,566,945 | 10/1996 | Sagucio | 273/284 |
| 5,839,725 | 11/1998 | Conway | 273/277 X |

*Primary Examiner*—John A. Ricci

*Attorney, Agent, or Firm*—Thomas, Kayden, Horstemeyer & Risley

[57] ABSTRACT

A board game for playing simulated ice hockey comprises a game board having indicia representing an ice hockey rink, perimeter wall sections surrounding at least a portion of the perimeter of said board against which dice are thrown, and a first and second series of spaces sized and shaped for placement of ice hockey player trading cards. The game board also has a pair of parallel folds formed therein approximately equally spaced from the side edges of said game board to form side segments of the game board which are approximately equal to the height of the perimeter wall sections so that the game board is foldable at said folds to place the side segments of said game board in overlying parallel relationship and the wall sections at said side edges of said game board in telescoped relationship with each other. A supply of ice hockey player trading cards, which bear the images of ice hockey players, dice, penalty markers and record sheets are also included for game play.

12 Claims, 3 Drawing Sheets

BOARD GAME FOR PLAYING SIMULATED ICE HOCKEY

FIELD OF THE INVENTION

The present invention relates to board games. More specifically, the present invention relates to a board game incorporating ice hockey player trading cards for playing simulated ice hockey.

DESCRIPTION OF THE PRIOR ART

Various games for simulating the play of sports are known in the prior art and, in particular, prior art games are known for simulating the play of ice hockey. These games typically include a flat rectangular game board bearing indicia of an ice hockey rink playing surface with goals at each end of the board. Some of these games include indicia of ice hockey players which are typically represented by game playing pieces incorporating a standardized ice hockey player character on the piece and designated in two color schemes, one set of playing pieces incorporating one color scheme for representing one hockey team and another set of playing pieces incorporating a separate color scheme for representing an opposing hockey team. The playing pieces can be maneuvered around the playing surface by the gamers playing the game through the use of mechanical linkages which allow the gamers to simulate an ice hockey game. Other prior art games do not include game pieces representing hockey players, but provide game pieces in the form of miniature hockey pucks and hockey sticks so that the gamers can simulate the play of an actual a hockey game by sliding or flicking the puck across the game board with the miniature hockey sticks. Although the prior art games have provided numerous entertainment hours to gamers throughout the years, there are no prior art games that incorporate the use of hockey player trading cards to stimulate game play and generate additional enthusiasm about the sport of professional ice hockey.

In general, sports player trading cards representing professional athletes of all sports have become very popular among sports enthusiasts and collectors. Sports player trading cards are typically small rectangular sections of paper board bearing the photograph or likeness of an athlete on one face, while including statistical information about the athlete's sports accomplishments on the opposing face. Cards are typically printed and reissued with updated statistical information each year, and additionally, can be printed to commemorate significant sporting accomplishments, such as an athlete being a member of a championship team or receiving an award, such as Most Valuable Player or Rookie of the Year.

Sports player trading cards are often collected and traded by sports enthusiasts and collectors of sports memorabilia. However, player trading cards, which are often sold in small random sets of three to five cards, have not been adapted for use in a board game. Use of player trading cards in this manner can potentially improve sales of cards while providing entertainment as well as potentially stimulating an interest in professional sports. Therefore, there is a need to provide an improved board game which incorporates the use of sports player trading cards and, in particular, incorporates ice hockey player cards for use in a simulated ice hockey game.

SUMMARY OF THE INVENTION

Briefly described, the present invention comprises a board game for playing simulated ice hockey which includes a foldable rectangular board that unfolds to provide a flat surface for game play. The board has a perimeter wall surrounding almost three edges of the board, leaving one open or unwalled edge adjacent the position where the gamers normally would sit. The perimeter wall is arranged to contain a set of dice, which are rolled during game play, within the perimeter of the game board. The board also has locations for the placement of cards which would typically be ice hockey player trading cards. The cards are placed in a series of recesses, which can be defined by a series of raised card spacers and which can be incorporated to form two rows of player cards, one row for one hockey team and the other row for an opposing hockey team. Additional recesses for the placement of trading cards representing team goalies also can be provided.

Rolling of the dice determines the play of the game, wherein one throw of the dice represents a play for one hockey player as well as an opportunity for that player to earn a shot on goal, a point or a penalty. Rules of play, which are included in the game, establish a method for evaluating each roll of the dice, and thereby determine the result of each roll. The hockey players on each team are alternately provided an opportunity for play until the players of each team have played and the results of each play is recorded on a record sheet. The process of rolling dice and recording results continues until the game is completed, with the gamer whose team scores the most points becoming the winner.

When a roll of the dice indicates that a player has earned a penalty, the player is placed in a penalty box and prohibited from playing for a given number of turns. A player in the penalty box is designated by placing a penalty marker, a disk incorporating a red slash, over the face of the playing card representing that player. There also can be other combinations of dice for other events that would take place during the game.

It is therefore an object of the present invention to provide an improved board game for simulating play of an ice hockey game which incorporates the use of ice hockey player trading cards to stimulate enthusiasm about the sport of professional ice hockey.

It is another object of the present invention to provide a board game that creates an improved market for the sale of sports trading cards.

It is still another object of the present invention to provide an ice hockey board game that includes a foldable game board incorporating a partial perimeter wall for retaining rolled dice within the perimeter of the board.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DETAILED DESCRIPTION OF THE PREFERRED EMBODIMENTS

Figure 1:
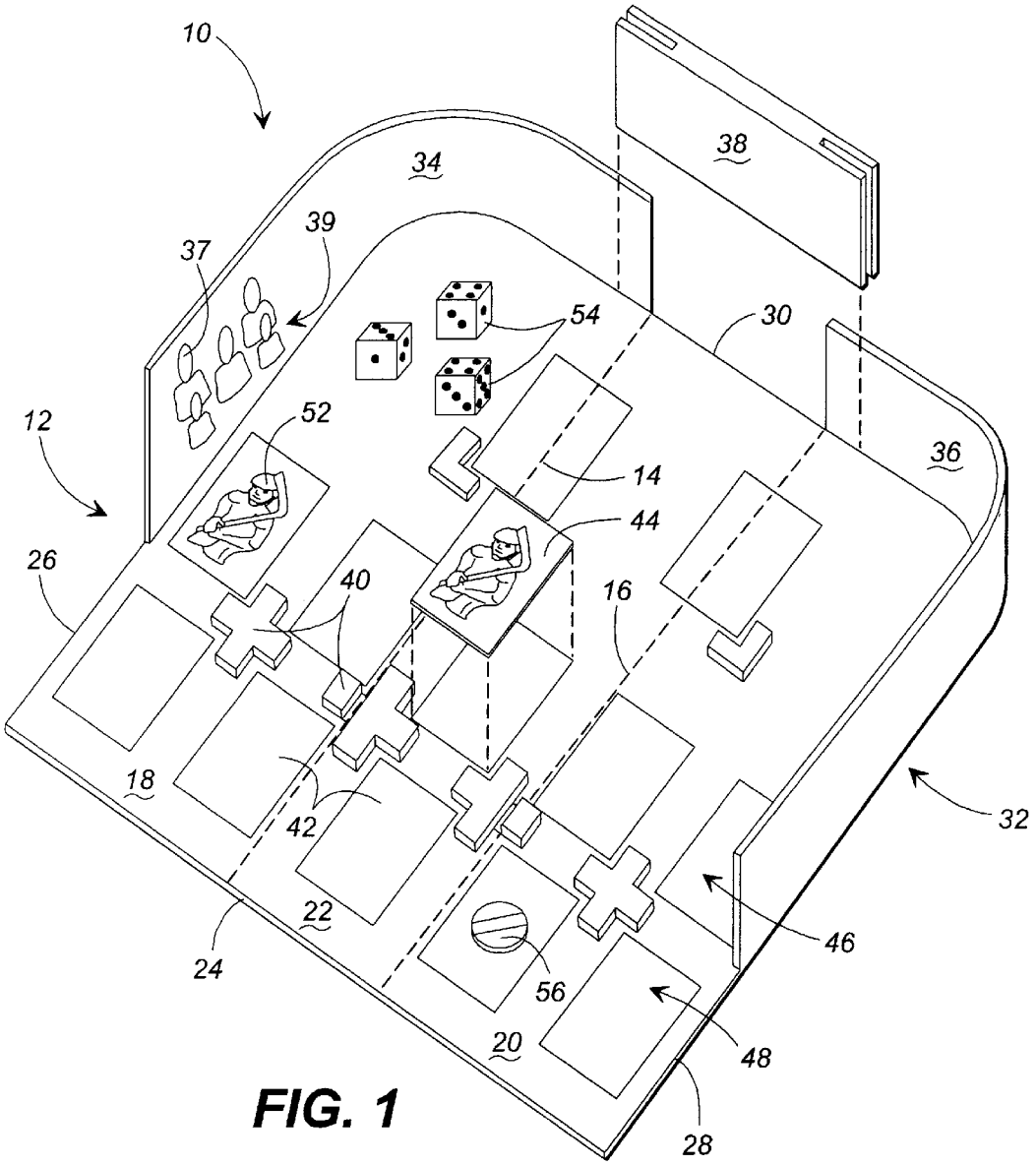
FIG. 1 illustrates a partially exploded perspective view of the preferred embodiment of the present invention showing detail of the removable center wall section.

Reference will now be made in detail to the description of the invention as illustrated in the drawings with like numerals indicating like parts throughout the several views. The board game 10, as shown in FIG. 1 and constructed in accordance with the preferred embodiment of the present invention, includes a game board 12 of a substantially rectangular shape. Board 12 has folds 14 and 16 that allow the board 12 to be folded into three lengthwise segments, including board side segments 18 and 20, and a board center segment 22. The board has a front edge 24, side edges 26 and 28, and a back edge 30, with side edges 26 and 28 intersecting back edge 30 along radii so that the intersections of the respective edges are curved, thereby simulating the end of an actual ice hockey rink. Indicia representing markings found on a typical hockey rink can be included on the board surface, including the center red line, a blue line, face off circles and a goal.

Figure 2:
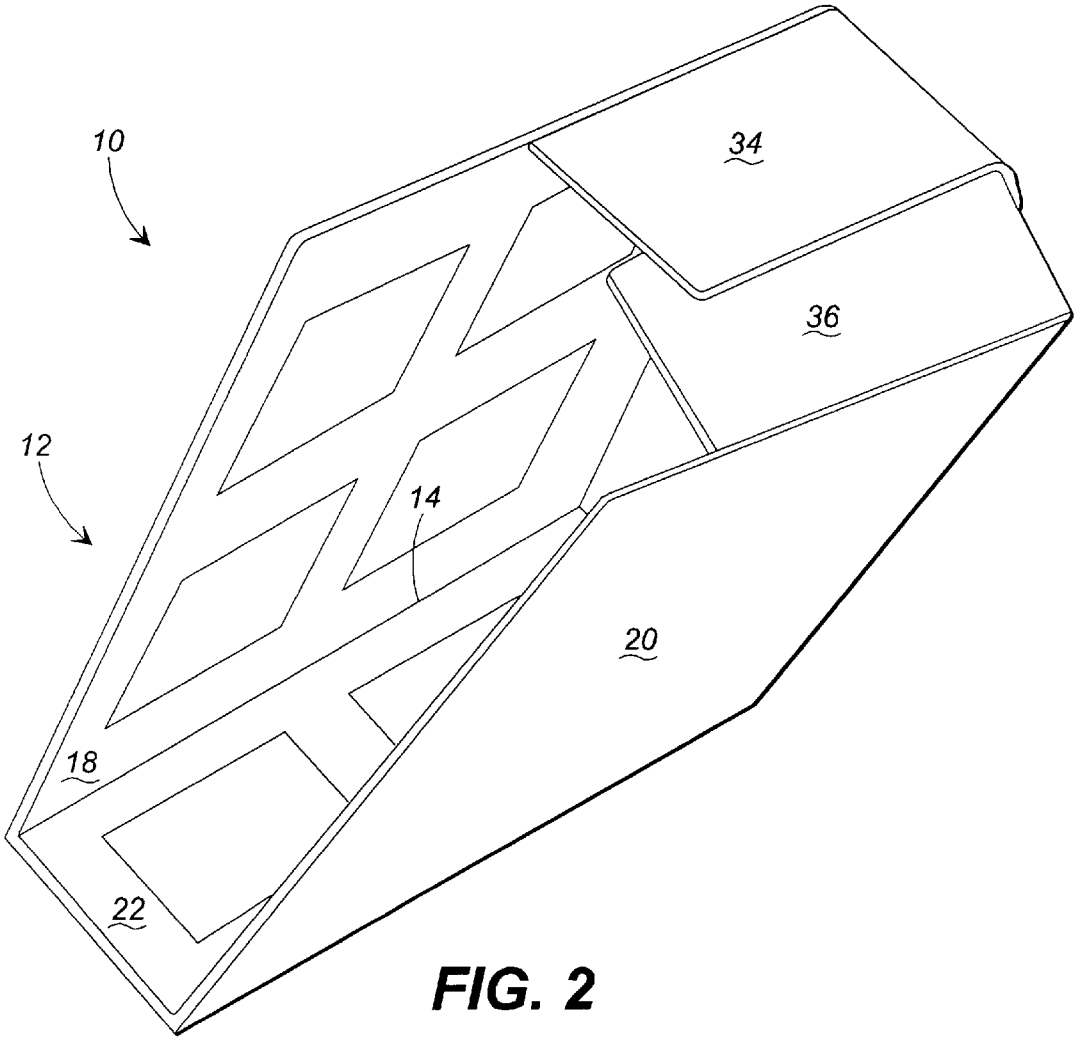
FIG. 2 illustrates a perspective view of the preferred embodiment of the present invention showing the board with the removable center wall section removed and the board folded for storage.

The board 12 also includes a perimeter wall 32 formed from side wall sections 34 and 36, and center wall section 38 so that the perimeter wall 32 extends entirely around the back edge 30 and substantially down the length of each side edge 26 and 28 to form a complete U shaped wall around the three edges, against which three dice can be thrown. Center wall section 38, which spans the portion of the perimeter wall 32 adjacent board center segment 22, removably engages side wall sections 34 and 36 to allow for folding of the board 12 when the center wall section 38 is removed. As shown in FIG. 2, side wall sections 34 and 36 are adapted and arranged to telescopically engage each other when the board 12 is folded so that board side segments 18 and 20 can maintain a substantially parallel orientation to each other for storage. Additionally, the perimeter wall can incorporate indicia of spectators 37 sitting in bleachers as well as commercial advertisements 39 which are commonly mounted to the interior of the perimeter wall at actual ice hockey rinks.

Spacers 40 are attached to the board 12 and are shaped to form recesses 42 which are adapted to receive portions of hockey player trading cards 44. Recesses 42 are arranged to form two opposing sets of five recesses 42 such that a first set 46 of recesses for a first hockey team is formed, and a second set 48 of recesses for an opposing hockey team is formed. Typically, each trading card 44 bears the picture of a certain hockey player, together with some information about the player. Card protectors (not shown) formed as jackets of transparent material, such as plastic, can be used to protect the cards 44 from bending or tearing during play. Spacers 40 also can be used for creating recesses for the placement of trading cards representing the goalie for each team. Additionally, each recess 42 can incorporate indicia 52 representing a hockey player so that the board game can still be played without trading cards 44.

Dice 54, penalty markers 56 and record sheets 58 (FIG. 3), are also included to facilitate game play.

PLAY OF THE GAME

Figure 3:
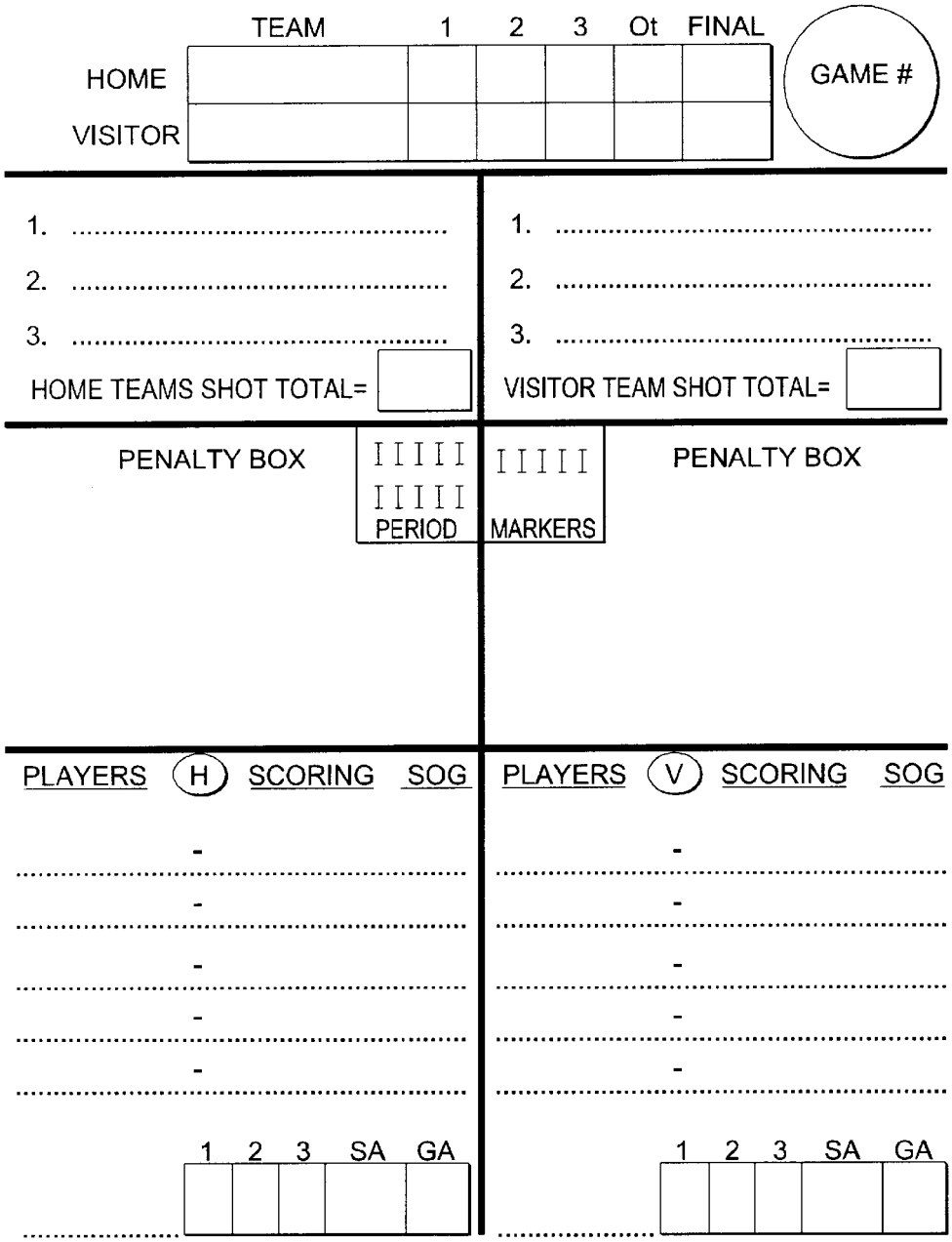
FIG. 3 illustrates a plan view of a record sheet of the preferred embodiment of the present invention.

With reference to FIGS. 1, 3 and 4, the manner of play of the invention will be described. The board 12 is unfolded and arranged on a suitable surface and the center wall section 38 is attached to side wall sections 34 and 36 so that the perimeter wall 32 is formed. Two opposing gamers designate, by coin toss or other appropriate means, who will represent the home team 46 and who will represent the visiting team 48. Each gamer then places a player trading card 44 in each of the recesses 42 so that each team is represented by six hockey players, with the home team players designated 1, 3, 5, 7, 9 and goalie, and the visiting team players designated 2, 4, 6, 8, 10 and goalie. If cards 44 are not available to the gamers, the hockey player indicia 52 can be utilized to represent the respective hockey teams. The names of the players from the trading cards 44 or the indicia 52 are then recorded on the record sheet 58 so that accurate game statistics can be maintained for each player.

Play commences with the gamer having the home team rolling the dice 54 on the board 12. This roll represents a play for player number 1, the first player from the home team. The roll is compared to the rules of play, which are included in the game, and a determination is made as to whether the play resulted in a shot on goal, a score, a penalty or no result at all. The result is then recorded on the record sheet 58. Next, player number 2, the first player from the visiting team, plays with the result recorded on the record sheet 58. Player 3 plays next, with each player sequentially making a play in numerical order thereafter. Once all players have had one play, a turn is completed. After five turns have been completed, a period is completed and the positions of the trading cards from the home team and the trading cards from the visiting team are interchanged between recesses 42, thereby simulating swapping of the ice which occurs during an actual hockey game. After three periods of play, the game is completed.

The combinations of numbers generated by the rolling of the dice 54 determine the result of each play. Three dice are provided for rolling with two of the dice being the same color and the third die being differently colored. This color configuration allows the rules of play to provide numerous play results, thereby allowing the play of the game 10 to more closely simulate the results and statistics produced from an actual ice hockey game. For example, if all of the rolled dice yield the same number, e.g. 3—3—3, that represents a "goal" being scored by that player. The goal is then recorded on the record sheet 58. If the dice 54 are rolled resulting in two of the dice yielding matching numbers, e.g. 3-4-3, the roll represents a "shot on goal." Additionally, if the dice with the matching numbers also match in color, then the different colored die, also known as the penalty die, must then be rolled again. If the number produced by the resulting roll of the penalty die does not match the numbers previously rolled on the matching dice, the roll is counted as a "shot on goal" for the player and that play is complete. If, however, the roll of the penalty die matches the previously rolled matched dice, the player on the opposing team corresponding to the shooting player, i.e. the player corresponding to the trading card situated either directly above or directly below the trading card of shooting player, receives a penalty and must be placed "in the penalty box." If the dice now match by showing the numbers 1, 2, 3 or 6, e.g. 1—1—1, 2—2—2, 3—3—3 or 6—6—6, the penalized player must remain in the penalty box for two turns. If the three dice now match by showing the numbers 4—4—4, the penalized player must remain in the penalty box for four turns, and likewise, if the three dice now match by showing the numbers 5—5—5, the penalized player must remain in the penalty box for five turns. A player "in the penalty box" is designated as such by placing a penalty marker 56 over the playing card representing that player. Placing a player "in the penalty box" enhances the other team's chances of scoring because the penalized player is prohibited from making his next play or plays depending on the severity of the penalty.

All game statistics, such as goals scored, shots on goal, and penalties are recorded on the record sheet 58. At the completion of three periods, the gamer whose team has recorded the most goals wins.

The foregoing description has been presented for purposes of illustration and description. It is not intended to be exhaustive or to limit the invention to the precise forms disclosed. Obvious modifications or variations are possible in light of the above teachings. Specifically, it is contemplated that the present invention is well suited for uses incorporating a network of processing systems linked together such that a limited number of flour supply and collection systems cooperate with a plurality of enclosures. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A board game for playing simulated ice hockey, comprising:

a game board having parallel side edges, an end edge and a centerline edge and markings thereon which simulate an end of an ice hockey rink with a goal adjacent said end edge;

a first designation of a series of spaces defined on said game board sized and shaped for placement of identification cards of players for a first team of ice hockey players, and a second designation of a series of spaces defined on said board sized and shaped for placement of identification cards of players of a second team of ice hockey players;

a first supply of identification cards which bear the images of ice hockey players, the cards of said first supply of identification cards being sized and shaped to correspond to the size and shape of the spaces of said first series of spaces for placement on the spaces of said first series of spaces, and a second supply of identification cards which bear the images of ice hockey players, the cards of said second supply of identification cards being sized and shaped to correspond to the size and shape of the spaces of said second series of spaces for placement on the spaces of said second series of spaces;

a wall surrounding at least a portion of said end edge and said side edges of said game board simulating the boards at one end of an ice hockey rink and for providing a surface against which dice are thrown; and said game board having a pair of parallel folds formed therein approximately equally spaced from the side edges of said game board to form side sections of the game board and spaced from each other a distance to form a center section of the game board approximately equal to the height of said wall so that said game board is foldable at said folds to place the side sections of said game board in overlying parallel relationship and the walls at said sides of said game board in telescoped relationship with each other.

2. The board game of claim 1, wherein said end edge intersecting each of said side edges in a radius, and said wall curved along each radius.

3. The board game of claim 2, wherein said wall is further defined as incorporating a detachable wall segment for engaging the edge of the center section of said board such that the wall section is detached from the edge of said center section prior to folding said board.

4. The board game of claim 3, wherein said wall is further defined as being detachable from said board.

5. The board game of claim 1, wherein said first and second designations of a series of spaces comprises a first series of recesses arranged in a first line and each recess of said first series being sized and shaped to receive an identification card, and a second series of recesses arranged in a second line and each recess of said second series being sized and shaped to receive an identification card.

6. The board game of claim 1, further comprising a plurality of penalty marker game pieces.

7. A game for playing simulated ice hockey, comprising:

a first supply of identification cards which bear the images of ice hockey players designating players of a first ice hockey team;

a second supply of identification cards which bear the images of ice hockey players designating players of a second ice hockey team;

a plurality of dice for rolling such that each roll of said plurality of dice represents a turn of play for each of said players;

said plurality of dice presenting combinations of numbers during each of said turns of play corresponding to opportunities for scoring points and awarding penalties; and, recording means for recording each turn of play, each point scored and each penalty awarded.

8. A game for playing simulated ice hockey comprising:

indicia designating players of a first ice hockey team;

indicia designating players of a second ice hockey team; and, a plurality of dice for rolling such that each roll of said plurality of dice represents a turn of play for each of said players;

said plurality of dice presenting combinations of numbers during each of said turns of play corresponding to opportunities for scoring points and awarding penalties;

said indicia designating players of a first ice hockey team being defined as a first supply of identification cards which bear the images of ice hockey players and said indicia designating players of a second ice hockey team being defined as a second supply of identification cards which bear the images of ice hockey players.

9. A board game for playing simulated ice hockey, comprising:

a game board having side edges, an end edge and indicia thereon which simulate an end of an ice hockey rink with indicia of a goal adjacent said end edge;

said game board having indicia of players of a first ice hockey team and indicia of players of a second ice hockey team;

a wall surrounding at least a portion of said end edge and said side edges of said game board for providing a surface against which dice are thrown; and dice.

10. The board game of claim 9, wherein said indicia of players of said first ice hockey team are further defined as a first supply of identification cards which bear the images of ice hockey players and said indicia of players of said second ice hockey team are further defined as a second supply of identification cards which bear the images of ice hockey players.

11. A board game for playing simulated sports, comprising a game board having side edges, an end edge and indicia thereon which simulate an end of a sports playing area for playing a sport;

said game board having indicia of players of a first sports team and a second sports team;

a wall surrounding at least a portion of said end edge and said side edges of said game board for providing a surface against which dice are thrown; and dice.

12. The board game of claim 11, wherein said indicia of players of said first sports team are further defined as a first supply of identification cards which bear the images of players of said sport and said indicia of players of said second sports team are further defined as a second supply of identification cards which bear the images of players of said sport.

* * * * *